US011272745B2

(12) United States Patent
Gazit et al.

(10) Patent No.: US 11,272,745 B2
(45) Date of Patent: Mar. 15, 2022

(54) SOCK WITH INTEGRALLY KNIT GRIP STRIPS OF VARYING WIDTHS

(71) Applicant: NIKE, Inc., Beaverton, OR (US)

(72) Inventors: Merav Gazit, Beaverton, OR (US); Daniel Shirley, Beaverton, OR (US); David Malul, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 108 days.

(21) Appl. No.: 16/696,119

(22) Filed: Nov. 26, 2019

(65) Prior Publication Data

US 2020/0221791 A1 Jul. 16, 2020

Related U.S. Application Data

(60) Provisional application No. 62/792,247, filed on Jan. 14, 2019.

(51) Int. Cl.

| | |
|---|---|
| ***A41B 11/02*** | (2006.01) |
| ***A41B 11/00*** | (2006.01) |
| ***D04B 1/26*** | (2006.01) |
| ***D04B 1/24*** | (2006.01) |
| ***D04B 1/00*** | (2006.01) |
| ***D04B 1/22*** | (2006.01) |

(52) U.S. Cl.

CPC ..... *A41B 11/02* (2013.01); *A41B 11/008* (2013.01); *D04B 1/26* (2013.01); *A41B 2400/80* (2013.01); *D04B 1/00* (2013.01); *D04B 1/22* (2013.01); *D04B 1/24* (2013.01); *D10B 2331/04* (2013.01); *D10B 2401/02* (2013.01); *D10B 2403/00* (2013.01); *D10B 2501/021* (2013.01)

(58) Field of Classification Search

CPC ... A41B 2400/80; A41B 11/008; A41B 11/02; D04B 1/26; D04B 9/56; D10B 2501/021; D10B 2403/00

USPC ..... 66/178 R, 182, 183, 184, 185, 186, 187, 66/188, 189, 201

See application file for complete search history.

(56) References Cited

U.S. PATENT DOCUMENTS

| | | | | |
|---|---|---|---|---|
| 2,102,368 A | | 12/1937 | Martel | |
| 4,104,892 A | * | 8/1978 | Thorneburg | A41B 11/02 2/239 |
| 4,149,274 A | | 4/1979 | Garrou et al. | |
| 4,732,015 A | | 3/1988 | Abrams et al. | |

(Continued)

FOREIGN PATENT DOCUMENTS

| | | |
|---|---|---|
| DE | 20219015 U1 | 4/2003 |
| EP | 2395141 A2 | 12/2011 |
| WO | 2016/187105 A1 | 11/2016 |

OTHER PUBLICATIONS

International Search Report and Written Opinion received for PCT Patent Application No. PCT/US2019/064172, dated Feb. 10, 2020, 12 pages.

(Continued)

*Primary Examiner* — Jameson D Collier
*Assistant Examiner* — Matthew R Marchewka
(74) *Attorney, Agent, or Firm* — Shook, Hardy & Bacon L.L.P.

(57) ABSTRACT

A sock has integrally knit grip strips where a first area of the grip strip has a first number of grip yarn knit courses and a second area of the grip strip has a second number of grip yarn knit courses different from the first number of grip yarn knit courses.

16 Claims, 9 Drawing Sheets

(56) References Cited

U.S. PATENT DOCUMENTS

| | | | | |
|---|---|---|---|---|
| 5,211,035 | A * | 5/1993 | Hanson, II | A41B 11/003 66/187 |
| 5,335,517 | A | 8/1994 | Throneburg et al. | |
| 5,412,957 | A | 5/1995 | Bradberry et al. | |
| 5,708,985 | A * | 1/1998 | Ogden | D04B 1/04 2/239 |
| 6,324,874 | B2 | 12/2001 | Fujimoto | |
| D590,590 | S | 4/2009 | Bonzagni et al. | |
| 7,677,061 | B2 | 3/2010 | Mori et al. | |
| 7,748,240 | B1 | 7/2010 | Cherneski | |
| D643,207 | S | 8/2011 | Hollingsworth et al. | |
| 8,220,077 | B1 | 7/2012 | Ott et al. | |
| 8,544,300 | B2 | 10/2013 | Kaneda et al. | |
| D740,014 | S | 10/2015 | Amis | |
| 9,301,552 | B2 | 4/2016 | Dickson | |
| 9,358,172 | B2 | 6/2016 | Collins et al. | |
| D762,057 | S | 7/2016 | Hakeem | |
| D773,798 | S | 12/2016 | Amis | |
| D776,913 | S | 1/2017 | Hakeem | |
| 2014/0311187 | A1 | 10/2014 | Amarasiriwardena et al. | |
| 2017/0035120 | A1 * | 2/2017 | Ramsey | D04B 1/12 |
| 2017/0295851 | A1 | 10/2017 | Thibodeau | |
| 2017/0311650 | A1 | 11/2017 | Hupperets et al. | |

OTHER PUBLICATIONS

"Five Things to Know About Nike's New NBA Socks," Nike News, nike.com, Sep. 15, 2017. https://web.archive.or g/web/20170930140827/ https://news.nike.com/news/nba-socks.

"Ronnox Women's Cushioned Anti-Skid Non-Slip Silicone-Gripper Socks, For Yoga Pilates & Barre (Fits Women's Shoe Size 8-14)," Amazon, amazon.com, ASIN: B071W2JXXR, Oct. 26, 2017. https:// www.amazon.com/dp/B071W2JX XR.

"Home: TRUSOX®—Performance Enhancing Socks," Trusox, trusox. com, Aug. 14, 2013. https:// web.archive.org/web/20130814050226/ http://www.trusox.com.

International Preliminary Report on Patentability received for PCT Patent Application No. PCT/US2019/064172,dated Jul. 29, 2021, 8 pages.

* cited by examiner

SOCK WITH INTEGRALLY KNIT GRIP STRIPS OF VARYING WIDTHS

CROSS-REFERENCE TO RELATED APPLICATIONS

This application, entitled "Sock with Integrally Knit Grip Strips of Varying Widths," claims the benefit of priority of U.S. Prov. App. No. 62/792,247, filed Jan. 14, 2019, and entitled "Sock with Integrally Knit Grip Strips of Varying Widths," the entirety of which is incorporated by reference herein.

TECHNICAL FIELD

Aspects herein include a sock with integrally knit grip strips, where one or more of the grip strips has a varying width along its length.

BACKGROUND

Socks with grip features are typically formed by applying surface treatments to the sock in a post-knitting step.

DESCRIPTION OF THE DRAWINGS

Examples of aspects herein are described in detail below with reference to the attached drawing figures, wherein.

DETAILED DESCRIPTION

Figure 1:
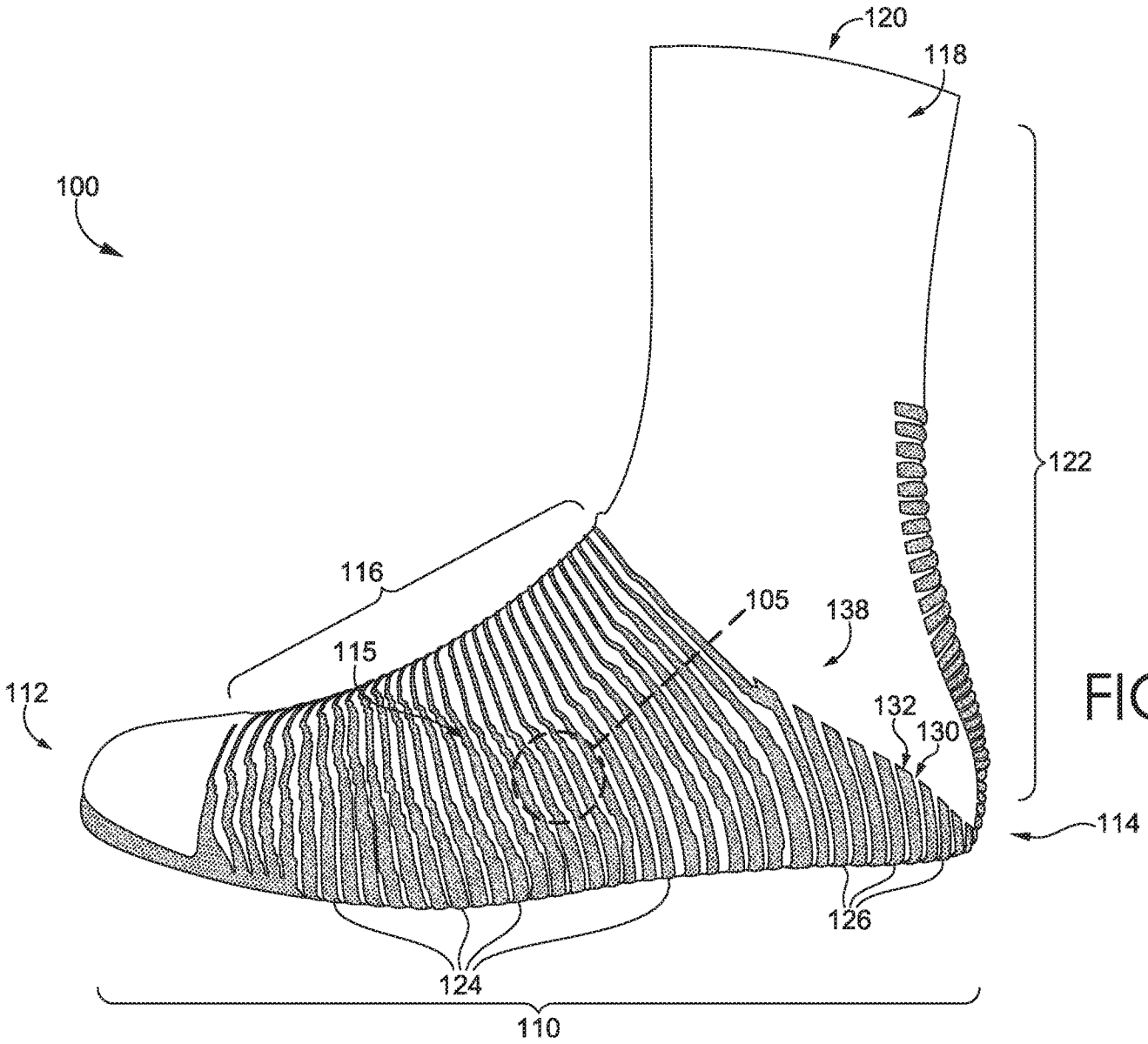
FIG. 1 illustrates a lateral view of an example sock have integrally knit grip strips of varying widths in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to sock having customized grip features in the form of integrally knit grip strips, where one or more of the grip strips may have a varied width along its length to provide more or less grip in a particular area. The grip strips present a contact surface on both the interior of the sock and the exterior of the sock. As such, the grip strips help to provide traction between a wearer's skin surface and the sock, and between the sock and a wearer's shoe when worn. The result is that the sock is less likely to shift against the wearer's skin surface, and the shoe is less likely to slip against the sock. In one aspect, the customized grip features may be located on the sock using a foot pressure map generated using data (e.g., force motion capture, video, static maps) that reflects the different foot motions and/or foot contact areas of a particular sport. As an example, with respect to soccer, the captured data may include acceleration motions, jogging motions, cutting motions, planting motions, kicking motions, areas of contact with a ball, and the like. The foot pressure map may be converted into a knitting data file (i.e., a bitmap) that is used to instruct, for example, a circular knit machine or a flat knit machine to knit the sock.

With respect to the sock as a whole, the integrally knit grip strips may extend circumferentially around the sock at a mid-foot area resulting in grip strips positioned on a dorsal portion of the sock (the portion of the sock configured to cover the instep area of a wearer's foot). This positioning may help to secure the upper portion of a shoe, especially the throat and/or tongue area, to the wearer's foot. This positioning may be especially beneficial when the wearer's shoe upper comprises, for instance, a knit, quilted, or non-woven construction which may impart more texture on the inside surface of the shoe upper (the surface of the upper that faces the wearer's sock). Because of the texture, the grip strips may better mechanically engage (i.e., create more friction) with the inside surface of the shoe upper helping to lock the shoe upper into place on the dorsum of the wearer's foot as opposed to the shoe upper sliding against the sock surface.

With further respect to the circumferentially extending grip strips, in example aspects, the width of a particular strip may be greater on a plantar portion of the sock to provide enhanced grip between the bottom of the wearer's foot, the sock, and the sole of the wearer's shoe. And the width of the strip may be less on the dorsal portion of the sock to avoid having too much grip in this area especially in view of the more sensitive (e.g., thinner) skin on the dorsum of the wearer's foot. The width of the strip may gradually decrease as the strip extends from the plantar portion, along the medial and lateral portions of the sock, to the dorsal portion of the sock. In an example aspect, the width of the grip strips over the medial and lateral portions of the sock may be greater than, for instance, the width of the grip strips on the dorsal portion of the sock based on likely contact areas of the wearer's shoe with a ball, such as a soccer ball. For instance, soccer players often kick the ball with the lateral and medial sides of their forefoot. By having more grip features in this area, the sock and the shoe are less likely to shift relative to the wearer's foot surface during kicking motions.

Continuing, in example aspects, the grip features may not extend over a dorsal toe area of the sock. Not having grip features in the dorsal toe area may facilitate more movement between the shoe, sock, and the wearer's toes thereby avoiding potential injury to the sensitive nail structures of the wearer's foot as may occur if there is too much grip (i.e., less movement) in this area. In further example aspects, the back end of the sock may comprise integrally knit grip strips that extend superiorly a predetermined distance along the back portion such that, when worn, the grip strips are positioned adjacent to an Achilles tendon area of the wearer. This positioning reduces the chances of the heel of the shoe sliding during movements such as acceleration and running. It is further contemplated herein that the sock may include portions that are entirely formed from grip yarns as opposed to having grip yarn strips. For instance, the plantar portion of the sock may comprise a continuous grip area in the toe end of the sock, where this area is configured to be positioned adjacent to at least the ball of the wearer's foot when the sock is worn. The ball area of the wearer's foot is typically subject to a high amount of force (impact forces, acceleration forces, turning forces, planting forces, and the like) and a high amount of grip in this area helps to prevent the forefoot portion of the sock and shoe from shifting against the wearer's skin surface during movement.

With respect to the integrally knit grip strips having varying widths, in example aspects, a grip strip may be formed from one or more interlooped knit courses that are knit using a grip yarn (i.e., a yarn having a denier per filament of about 0.1 or less). A first area of the grip strip may comprise a first number of knit courses knit with the grip yarn, and a second area of the grip strip may comprise a second number of knit courses knit with the grip yarn where the second number of knit courses is different from the first number of knit courses. Areas of the grip strip having a greater number of knit courses would be wider than areas of the grip strip having a fewer number of knit courses.

A particular grip strip may comprise more than two areas that have a different number of knit courses. As an example, the grip strip may comprise a first area having a first number of knit courses, a second area having a second number of knit courses, and a third area of the grip strip may have a third number of knit courses. In aspects, the number of knit courses in each of these areas may be different causing a varying width in the different areas. Or the number of knit courses in the second area and the third area may be the same but be different from the number of knit courses in the first area also causing the grip strip to have a varying width. Additional combinations are contemplated herein. In one aspect, the grip yarn knit courses comprise a terry loop structure where the loop portions of the terry structure are positioned on the inner-facing surface of the sock to provide for increased yarn contact with the wearer's foot.

It is contemplated herein that adjacent grip strips may be separated by one or more knit courses formed using a non-grip yarn (i.e., yarns having a denier per filament of greater than about 0.1). These non-grip yarn courses are interlooped with the knit courses that form the grip strips. The non-grip yarn courses may be formed using, for example, polyester yarns to provide moisture-wicking features to the sock and to impart a soft hand.

Positional terms as used herein such as "medial," "lateral," "toe-end," "heel area," "front," "back" "interior surface," "exterior surface," "plantar," "dorsal," "mid-foot," "instep," and the like, are with a sock being worn as intended and as shown and described herein by a wearer standing in anatomical position. Thus, the medial portion of the sock is configured to be positioned adjacent to a medial side of the wearer's foot, and the lateral portion of the sock is configured to be positioned adjacent to a lateral side of the wearer's foot. The toe-end of the sock is configured to be positioned adjacent to the toes of the wearer's foot, and the heel area of the sock is configured to be positioned adjacent to the heel of the wearer's foot. The dorsal portion of the sock is configured to be positioned adjacent to the dorsum of the wearers foot, and the plantar portion of the sock is configured to be positioned adjacent to the sole of the wearer's foot. The back of the sock is configured to be positioned adjacent to an Achilles tendon calf area of the wearer. As well, the interior surface of the sock is configured to face toward a skin surface of the wearer, and the exterior surface of the sock is configured to face away from the skin surface of the wearer. The mid-foot portion of the sock is configured to be positioned adjacent to an area approximately midway between the wearer's toes and the wearer's heel. The sock body includes a longitudinal axis that extends from the toe end to the foot opening and a transverse axis that extends between a medial side and a lateral side of the sock body, wherein the transverse axis intersects the longitudinal axis.

The term "knitted course" as described herein is a predominantly horizontal row of knitted loops (in an upright fabric as knit) produced by adjacent needles during the same knitting cycle. The knitted course may comprise one or more stitch types such as a loop stitch, a held stitch, a float stitch, a tuck stitch, a transfer stitch, and the like as these terms are known in the art of knitting.

The term "technical back" as used herein refers to the inner side or underside of the fabric or textile as it is being knit. The term "technical back" may also be defined as the side of the fabric or textile that contains back loops or purl loops. And the term "technical face" as used herein refers to the outer or upper side of the fabric or textile as it is being knit. The term "technical face" may also be defined as the side of the fabric or textile that contains face loops or weft knit loops.

The term "integrally knit" or "contiguous" as used herein may mean a textile or fabric having a yarn from one or more knitted courses being interlooped with one or more knitted courses of another area. For instance, a knit course from a grip strip may be integrally knit with a knit course from a non-grip area if a yarn from the grip strip knit course is interlooped with a knit course in the non-grip area. In another example, a first end of a grip strip may be contiguous with a second end of the grip strip if a yarn from the first end is interlooped with a yarn from the second end of the grip strip.

The term "plating" as used herein means a knit construction where a body yarn and a plating yarn are knitted in the same knit stitch using, for instance, a body yarn feeder and a plating yarn feeder. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include, LYCRA®, elastane, spandex, rubber, and the like. The term "about" used when, for instance, describing numbers or numerical ranges means within ±10% of a designated value unless indicated otherwise. Unless indicated otherwise, all measurements provided herein are taken when the sock is at standard ambient temperature and pressure (298.15 K and 100 kPa) and the sock is in a resting state (e.g., an unstretched state).

Continuing, it is contemplated herein that the grip strip may be knit with a yarn type having grip characteristics, which is known herein as a "grip yarn." In example aspects, a grip yarn refers to an elastomeric yarn that is covered with a yarn having a denier per filament that is less than or equal to about 0.1 or less (known herein as a "high filament yarn"). In example aspects, a high filament yarn comprises a single yarn strand that may include up to about 7000 or greater number of filaments such that the denier per filament of the high filament yarn is about 0.1 or less, about 0.05 or less, about 0.02 or less, or about 0.01 or less. The large number of filaments provides a high surface-to-volume ratio for the high filament yarn which contributes to the gripping function of the yarn. To describe it differently, the large number of filaments within the high filament yarn causes the high filament yarn to have a higher coefficient of friction as compared to, for example, more typical yarns that incorporate a smaller number of filaments within a single yarn strand such as yarns that incorporate from between, for example, 20 filaments to 500 filaments per single yarn strand. In one example aspect, the grip yarn comprises a 33 decitex spandex yarn that is covered with 1 end or strand of 78 decitex nylon having 24 filaments and 2 ends or strands of 110 denier high filament yarns. These are illustrative examples only, and in some aspects, it is contemplated that the grip yarn may comprise one or more ends of the high filament yarn by itself, or the grip yarn may comprise an elastomeric yarn that is covered with just one or more high filament yarns. Any and all aspects, and any variation thereof, are contemplated as being within the scope herein. In example aspects, the non-grip areas of the sock may knit with a different yarn type which may be referred to herein as a "non-grip yarn." As used herein, a non-grip yarn means a yarn having less than about 7000 filaments so that the denier per filament of the yarn is greater than about 0.1, greater than about 0.15, or greater than about 0.2. In one example aspect, the non-grip yarn comprises 2 ends or strands of 60 denier polyester twisted together where each stand comprises 36 filaments.

Figure 2:
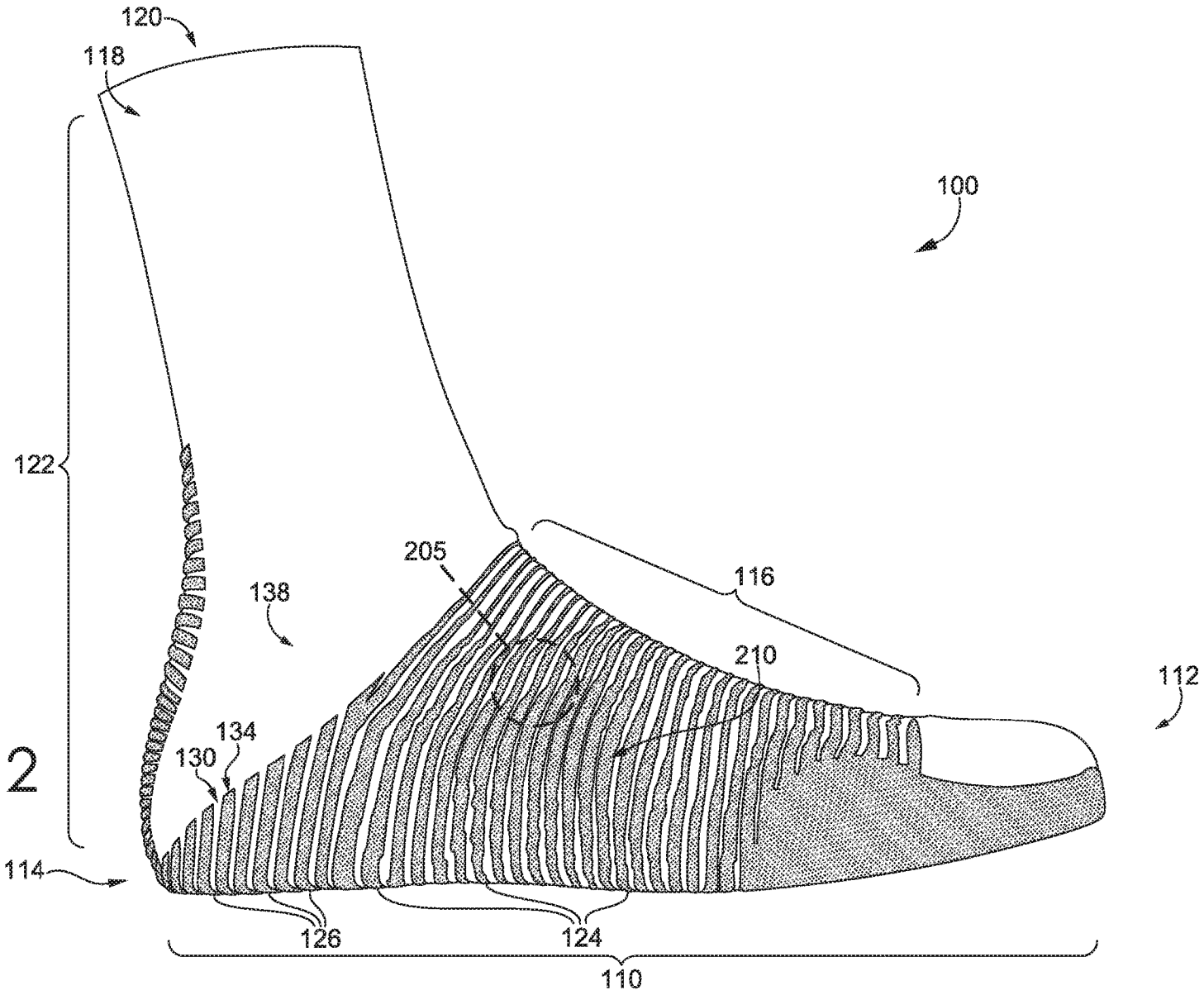
FIG. 2 illustrates a medial view of the sock of FIG. 1 in accordance with aspects herein.
Figure 3:
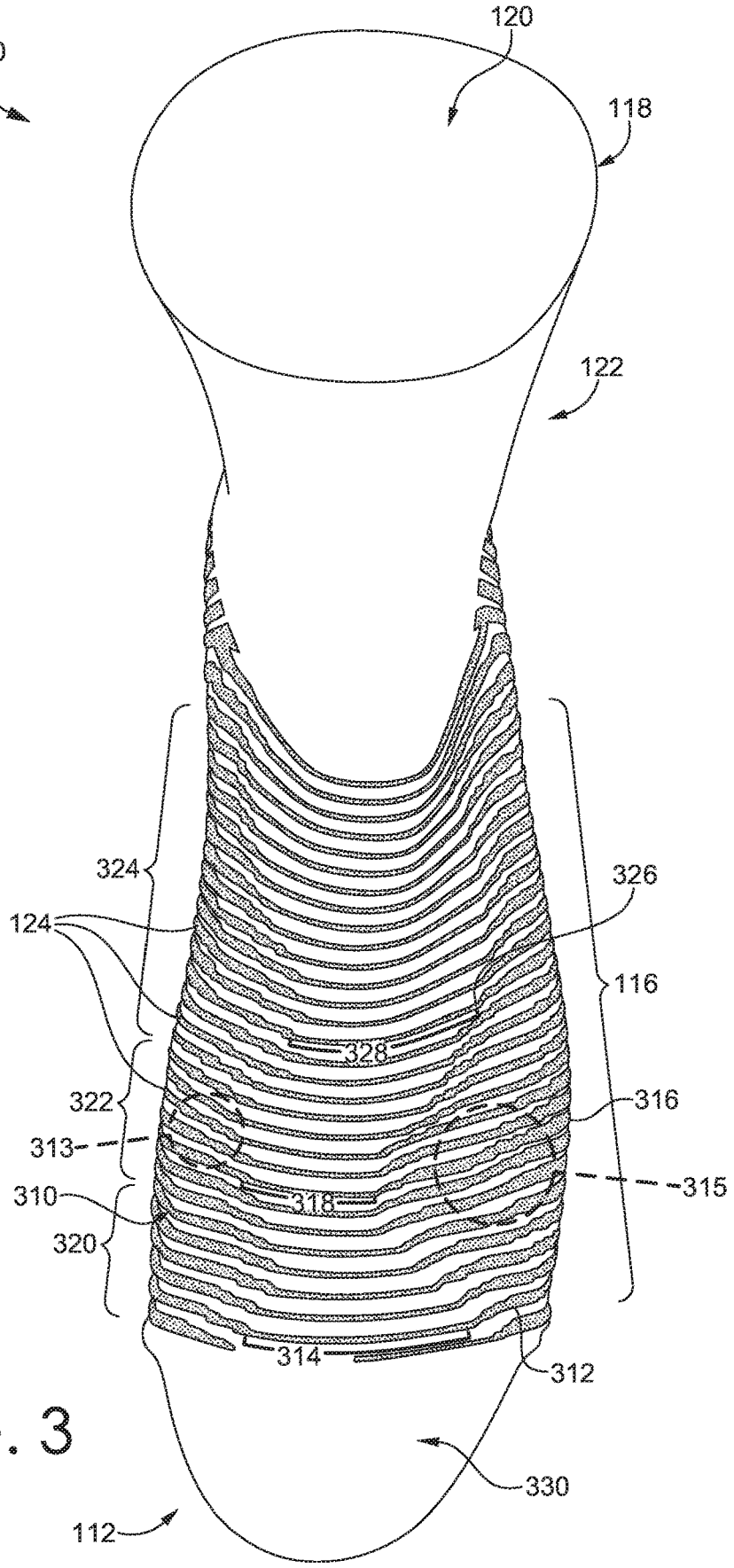
FIG. 3 illustrates a dorsal view of the sock of FIG. 1 in accordance with aspects herein.
Figure 4:
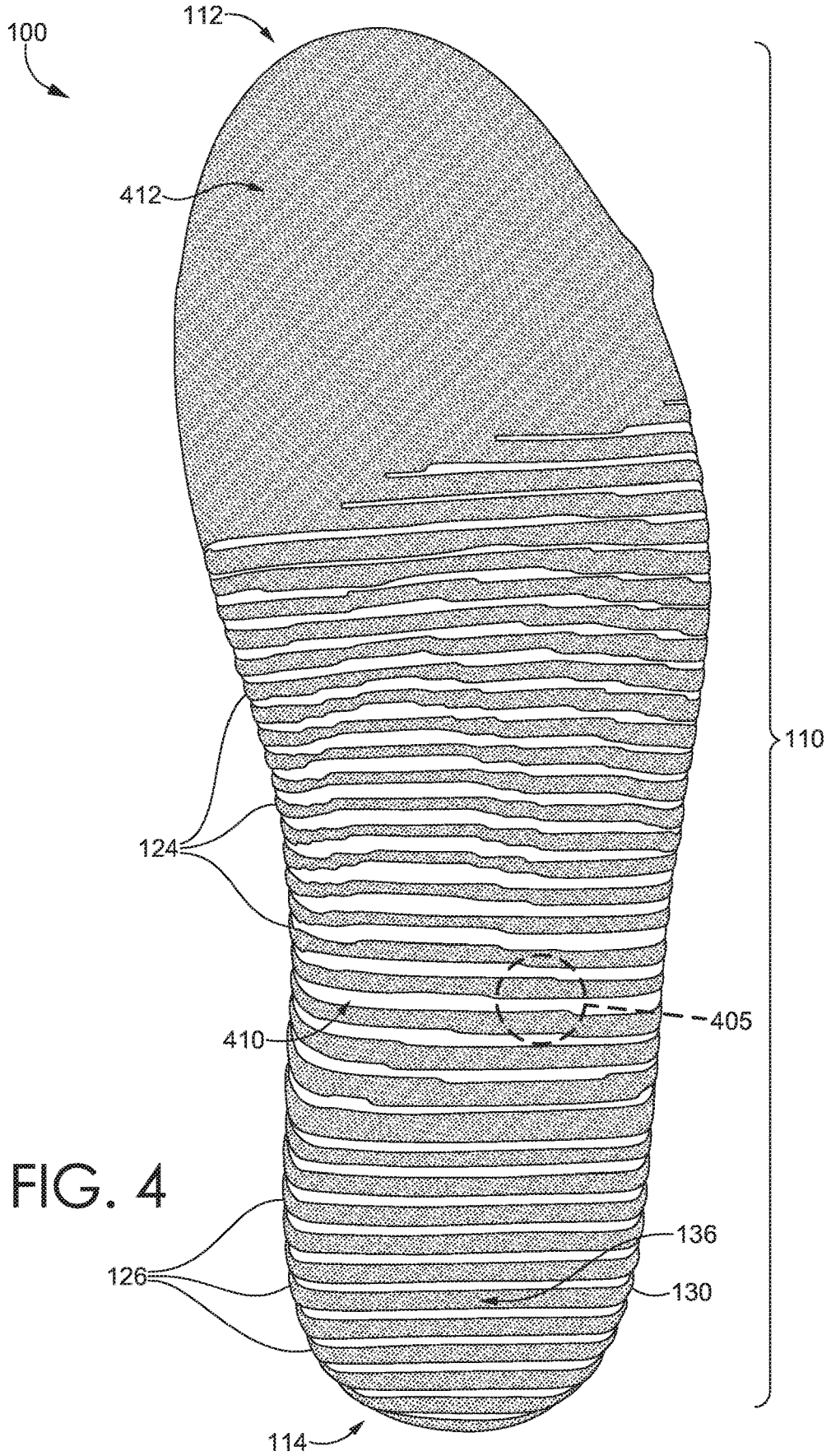
FIG. 4 illustrates a plantar view of the sock of FIG. 1 in accordance with aspects herein.
Figure 5:
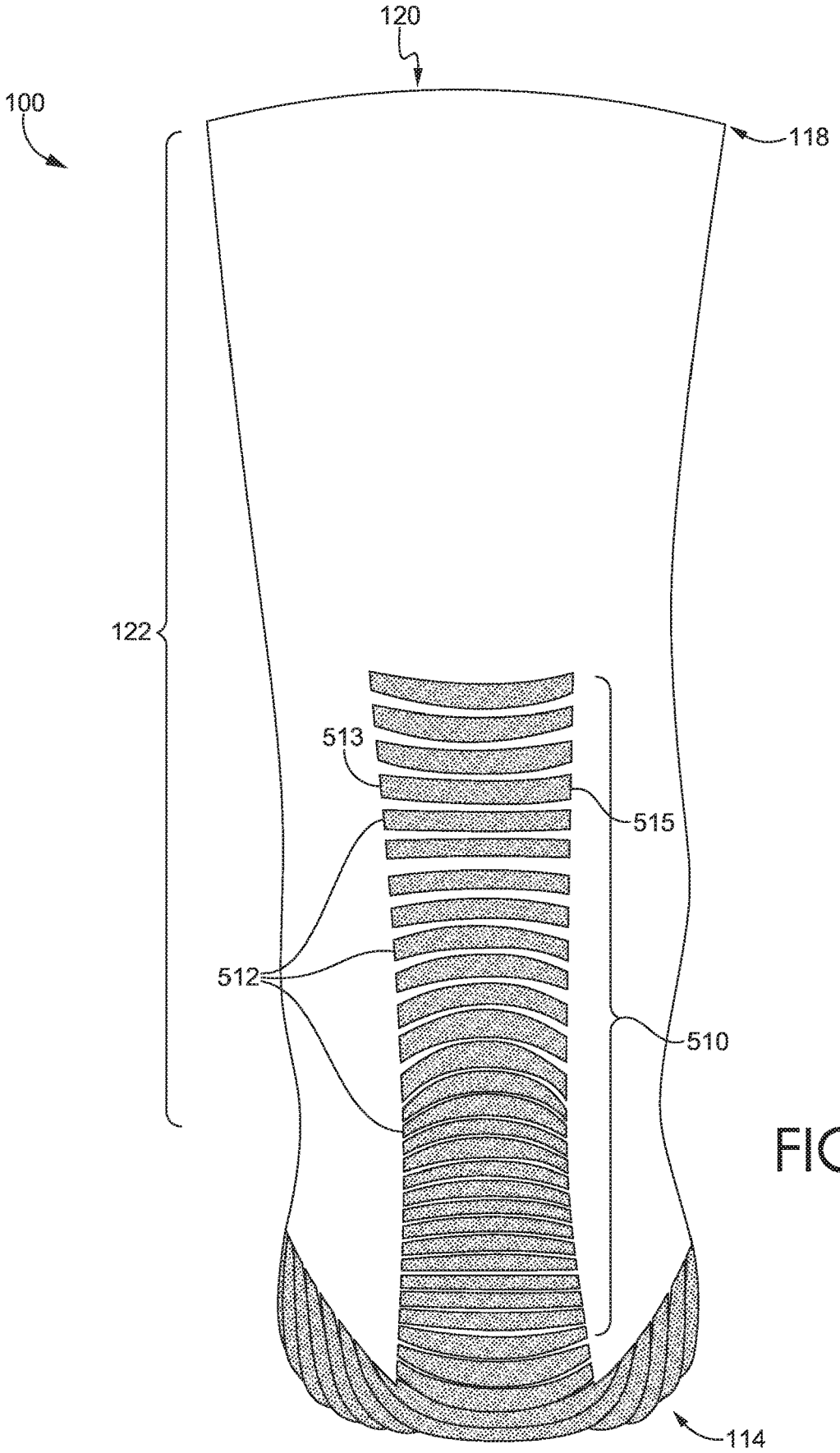
FIG. 5 illustrates a back view of the sock of FIG. 1 in accordance with aspects herein.

Turning now to FIGS. 1-5, several views of a sock 100 having integrally knit grip strips are provided in accordance with aspects herein. More particularly, FIG. 1 is a lateral view of the sock 100, FIG. 2 is a medial view of the sock 100, FIG. 3 is a dorsal view of the sock 100, FIG. 4 is a plantar view of the sock 100, and FIG. 5 is a back or heel-end view of the sock 100. With respect to FIG. 1, the sock 100 includes a tubular sock body 110 having a toe end 112, a heel area 114, a lateral portion 115, and a mid-foot area 116 positioned between the toe end 112 and the heel area 114. In example aspects, the mid-foot area 116 is configured to cover at least an instep area and an arch area of a wearer's foot. The sock 100 further includes a collar 118 that defines a foot opening 120 for receiving a wearer's foot, and a leg portion 122 that extends between the sock body 110 and the collar 118. It is contemplated herein that the leg portion 122 may comprise any number of lengths.

With respect to FIG. 2, besides the areas and portions described above, the sock 100 further includes a medial portion 210. And with respect to FIG. 3, the sock 100 also includes a dorsal portion 310. With reference to FIG. 4, the sock 100 additionally comprises a plantar portion 410. The heel-end view of FIG. 5 is provided to illustrate features associated with an Achilles tendon area 510 that extends superiorly from the heel area 114 of the sock 100 up the leg portion 122 a predetermined distance and is configured to cover an Achilles tendon area of a wearer when the sock 100 is worn. The different portions and areas described above are not intended to demarcate precise areas of the sock 100. Rather the different portions and areas are intended to represent general areas of the sock 100 to aid in the following discussion.

As shown collectively by FIGS. 1-4, the sock 100 comprises a first plurality of grip strips, referenced generally by the numeral 124 and shown as stippled in FIGS. 1-4. The first plurality of grip strips 124 extend circumferentially around the sock body 110. That is, each of the first plurality of grip strips 124 extends from the dorsal portion 310, around the lateral portion 115, around the plantar portion 410, around the medial portion 210, and back to the dorsal portion 310. In example aspects, each grip strip of the first plurality of grip strips 124 may comprise a first end and a second end, and the first end is contiguous with or integrally knit with the second end such that each grip strip of the first plurality of grip strips 124 forms a circular-like shape. More specifically, the first plurality of grip strips 124 extend circumferentially around the sock body at the mid-foot area 116 of the sock 100.

In general, each of the first plurality of grip strips 124 has a varying width as it extends circumferentially around the sock body 110. In other words, each of the first plurality of grip strips 124 has a varying width along its length. As best seen in FIG. 3, the grip strips 124 generally have the smallest width (i.e., least number of knit courses) on the dorsal portion 310 of the sock 100. As explained above, having some grip features present in the mid-foot area 116 of the dorsal portion 310 of the sock 100 may help to better secure a surface of a shoe upper to the dorsal portion 310 of the sock 100 and to better secure the dorsal portion 310 of the sock 100 to a wearer's skin surface thus preventing or reducing shifting between the shoe upper, the sock 100, and the wearer's foot. The presence of the grip strips 124 on the dorsal portion 310 of the sock 100 may be especially beneficial when a shoe upper to be worn by a wearer is formed of a knit construction, a quilted construction, a non-woven construction, or other type of construction that causes an interior surface of the shoe upper to have some sort of surface texture. In this instance, the textured shoe upper may better mechanically engage with the grip strips 124 on the dorsal portion 310 of the sock 100.

With continued respect to FIG. 3, the first plurality of grip strips 124 may be divided into hypothetical zones along the dorsal portion 310 of the sock 100. For instance, the zones may comprise a first zone 320, a second zone 322, and a third zone 324, where the first zone 320 is generally located adjacent (e.g., from about 3 cm to about 7 cm) to the toe end 112 of the sock 100, the third zone 324 is located at a rear aspect of the mid-foot area 116 of the sock 100, and the second zone 322 is located between the first zone 320 and the third zone 324. In example aspects, the second zone 322 is generally located at a middle aspect of the mid-foot area 116 of the sock 100 that corresponds generally to the joints between the phalanges and the metatarsal bones in a wearer's foot when the sock 100 is worn. The positioning of the zones 320, 322, and 324 described above are not intended to demarcate precise areas of the sock 100. Rather the zones 320, 322, and 324 are intended to represent general areas of the sock 100 to aid in the following discussion.

Continuing with respect to the zones 320, 322, and 324, it is contemplated herein that a length of the narrowed width portions of the grip strips 124 (i.e., the portion of a grip strip that is narrower than remaining portions of the grip strip) may also vary between the first zone 320, the second zone 322, and the third zone 324. As an example, the narrowed width portion of a representative grip strip 312 in the first zone 320 may have an average length 314 that is longer than an average length 318 of a representative grip strip 316 in the second zone 322. By having shorter length narrowed width portions of the grip strips 124 in the second zone 322 of the sock 100, the wider width portions of the grip strips 124 in the second zone 322 (i.e., the portion of the grip strip 312 that is wider than remaining portions of the grip strip 312) can extend further on to the dorsal portion 310 as compared to the first zone 320 as indicated generally by the circles 313 and 315. This helps to provide more grip surface on the lateral and medial portions 115 and 210 of the sock 100 in the second zone 322. Functionally this may be beneficial because, as explained above, the second zone 322 is generally located in an area that corresponds to the joints between the phalanges and the metatarsal bones in a wearer's foot. The medial and lateral sides of this area represent a common point of contact between the wearer's foot and, for instance, a soccer ball. Thus, having a greater grip surface in this area may prevent shifting between the wearer's shoe and the sock 100, and between the sock 100 and the wearer's skin surface.

In example aspects, the narrowed width portion of a representative grip strip 326 in the third zone 324 may have an average length 328 that is greater than the average length 318 of the grip strip 316 in the second zone 322. It is contemplated herein, that the average length 328 of the representative grip strip 326 in the third zone 324 may be the same as or different from the average length 314 of the representative grip strip 316 in the first zone 320. Have a longer length of the narrowed width portion of the grip strips 124 in the third zone 324 as compared to the second zone 322 means that the wider width portions of the grip strips 124 in the third zone 324 do not extend as far on to the dorsal portion 310 of the sock 100 as they do in the second zone 322 reflecting that third zone 324 of the sock 100 likely experiences less contact and/or motions forces along the lateral and medial portion 115 and 210 as compared to the second zone 322 of the sock 100.

With further respect to FIG. 3, the sock 100 includes a dorsal toe area 330 configured to cover a dorsal aspect of a wearer's toes when the sock 100 is in an as-worn configuration. In example aspects, the dorsal toe area 330 does not comprise any grip strips, such as the first plurality of grip strips 124. Instead, the dorsal toe area 330 of the sock 100 may comprise a continuous expanse of non-grip yarn courses that are interlooped with each other. The absence of grip strips and/or grip yarns in the dorsal toe area 330 means that the sock 100 has less grip in this area. This may be beneficial as the dorsal aspect of a wearer's toes includes sensitive toenail structures that may be damaged or impacted if movement between the wearer's toes and the sock 100 is restricted.

Turning now to FIGS. 1 and 2 which depict lateral and medial views respectively of the sock 100, as shown, the width of the first plurality of grip strips 124 gradually increases as the grip strips 124 transition from the dorsal portion 310 of the sock 100 to the plantar portion 410 of the sock 100 as indicated generally by the circles 105 and 205. As explained below, the increasing width is due to each grip strip 124 comprising a greater number of grip yarn courses on the lateral portion 115 and the medial portion 210 as compared to the number of grip yarn courses on the dorsal portion 310. As set forth above, the lateral portion 115 and the medial portion 210 of the sock 100 likely experience greater motion forces and/or contact forces than, for instance, the dorsal portion 310 of the sock. And by having a greater grip contact area in the lateral and medial portions 115 and 210, the sock 100 is better secured to the wearer's skin surface, and the shoe is better secured to the sock 100.

Continuing with FIGS. 1 and 2, in example aspects, the sock 100 may comprise a second plurality of grip strips 126 formed from a grip yarn. The second plurality of grips strips 126 may be positioned at the heel area 114 of the sock. And, in aspects, the second plurality of grip strips 126 may not extend circumferentially around the sock body 110. Instead, with respect to representative grip strip 130, the grip strip 130 may have a first end 132 positioned on the lateral portion 115 of the sock 100 (seen in FIG. 1), a second end 134 positioned on the medial portion 210 of the sock 100 (seen in FIG. 2) and an intervening portion 136 extending between the first end 132 and the second end 134 and positioned on the plantar portion 410 of the sock 100 (seen in FIG. 4). In example aspects, the first end 132 is not contiguous with or is integrally knit with the second end 134. To describe this differently, a plurality of non-grip yarn knit courses may extend between the first end 132 and the second end 134 of the representative grip strip 130, where the non-grip yarn knit courses are positioned on the dorsal portion 310 of the sock 100. It is contemplated herein that each of the second plurality of grip strips 126 may comprise a generally constant width along its length. In other words, each grip strip 126 may comprise generally the same number of grip yarn knit courses along its length. This may reflect that this area of the sock is subject to relatively constant motion and/or contact forces. However, it is also contemplated herein that each grip strip 126 may comprise a varying width along its length due to different areas of a particular grip strip having a different number of courses. Any and all aspects, and any variation thereof, are contemplated as being within aspects herein.

With further respect to the second plurality of grip strips 126, in example aspects, a length of the respective grip strips 126 may gradually decrease moving from the toe end 112 to the heel area 114 such that an ankle portion 138 of the sock 100 may not comprise the second plurality of grip strip 126. In example aspects, the ankle portion 138 of the sock 100 is configured to be positioned adjacent to the medial and lateral malleolus of a wearer. In one aspect, this may create a cleaner aesthetic for the sock 100. For instance, athletes often pull on their socks causing the ankle portion 138 to be pulled upward. By not having the grip strips 126 in this area, the demarcation between the leg portion 122 and the ankle portion 138 is visually blurred creating a clean aesthetic.

Turning now to FIG. 4, which illustrates a plantar view of the sock 100, and with respect to the first plurality of grip strips 124, the width of the first plurality of grip strips 124 further increases on the plantar portion 410 of the sock 100 as indicated generally by the circle 405. In other words, the width of respective grip strips 124 on the plantar portion 410 of the sock 100 is greater than the width of the respective grip strips 124 on the dorsal portion 310. The width of the respective grip strips 124 on the plantar portion 410 of the sock 100 may also be greater than the width of the grip strips 124 on the lateral portion 115 and the medial portion 210 of the sock 100. In example aspects, this is achieved by having a greater number of courses of grip yarn for each grip strip 124 on the plantar portion 410 of the sock 100. The plantar portion 410 of the sock 100 is subject to a high amount of both motion forces and contact forces (e.g., contact of the wearer's foot with the ground engaging surface of a shoe). Having a high amount of grip on the plantar portion 410 helps to secure the sock 100 to the wearer's skin surface and further helps to secure the sole surface of a shoe to the sock 100.

With continued respect to FIG. 4, the sock 100 further includes a plantar toe area 412 configured to be positioned adjacent to the plantar surface of the wearer's toes as well as the some or all of the ball area of the wearer's foot. In example aspects, the plantar toe area 412 may comprise a continuous expanse of grip yarn courses. That is, as opposed to the first plurality of grip strips 124 and the second plurality of grip strips 126 which include non-grip yarn knit courses separating adjacent grip strips 124, all or substantially all (i.e., greater than about 95%) of the plantar toe area 412 includes grip yarn knit courses. The grip yarn knit courses in the plantar toe area 412 are interlooped with each other and, in aspects, there are no intervening knit courses of non-grip yarns. The high amount of grip yarn knit courses in the plantar toe area 412 reflects that this area of the foot is subject to large amounts of motion forces and/or contact forces and that additional grip between the wearer's foot, the sock 100, and a shoe may be beneficial. FIG. 4 further depicts the second plurality of grip strips 126 and how they extend across the plantar portion 410 of the sock 100 at the heel area 114. As set forth above, in aspects it is contemplated that the width of the grip strips 126 as they extend across the plantar portion 410 may be constant. Having grip features in the heel area 114 helps to secure a shoe's heel to the sock 100.

Turning to FIG. 5, which depicts a heel-end or back view of the sock 100, the sock 100 further comprises the Achilles tendon area 510 that extends from the heel area 114 up the leg portion 122 of the sock 100. In example aspects, the Achilles tendon area 510 may comprise a third plurality of grip strips 512 that extend horizontally (e.g., in a medial-to-lateral direction) across the Achilles tendon area 510 where the grip strips 512 comprise a first end 513 and a second end 515. In example aspects, the first end 513 is not contiguous with or is not integrally knit with the second end 515. The third plurality of grip strips 512 may extend a predetermined distance up the leg portion 122 of the sock 100. For instance, the portion of the sock 100 comprising the third plurality of grip strips 512 may have a length from about 10 cm to about 30 cm, although lengths shorter or longer than these lengths are contemplated herein. In aspects, the width of each of the grip strips 512 may be generally constant along the respective strip's length in the Achilles tendon area 510, although it is also contemplated herein that the width may vary along the respective grip strip's length. Having grip features in the Achilles tendon area 510 may help to better prevent a heel area of a shoe from sliding up and down in this area thereby reducing chaffing.

Figure 6:
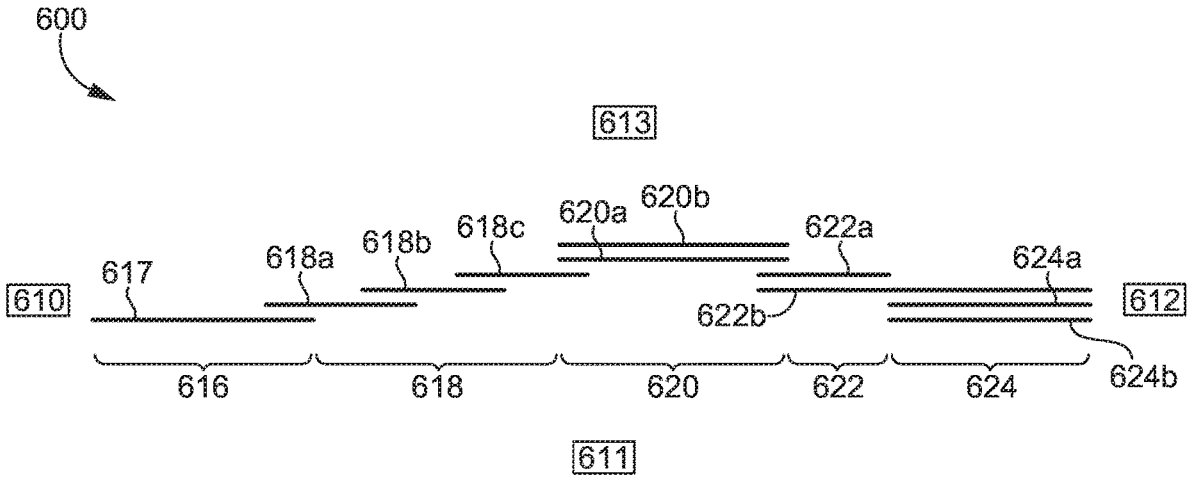
FIG. 6 illustrates a schematic representation of a grip strip having a varying width along its length in accordance with aspects herein.

Turning now to FIG. 6, a schematic depiction of a portion of a grip strip 600 is illustrated in accordance with aspects herein. Some features of the schematic depiction may be similar to that shown on a knit programming file (e.g., a bitmap) that is used in knitting a sock, such as the sock 100, having integrally knit grip strips of varying widths. As set forth above, the bitmap may be used to instruct a knit machine, such as a circular knit machine or a flat knit machine, in knitting the sock. The bitmap may be generated using data that captures the different motions and/or contact forces of a wearer's foot. In some aspects, the data may be captured with respect to a particular sport such as soccer, tennis, basketball, and the like. The data may reflect the average data associated with a group of athletes practicing the particular sport. In this situation, the bitmap, and the sock knitted based on the bitmap, represent an average of the motion and/or contact forces for the particular sport. Or the data may be specific to an individual athlete playing a particular sport, in which case the bitmap, and the sock knitted based on the bitmap, are customized to the individual athlete. Any and all aspects, and any variation thereof, are contemplated as being within aspects herein.

With respect to the grip strip 600, knit courses extend in a course-wise direction between a first side 610 and a second side 612 of the grip strip 600 and extend in a wale-wise direction between a third side 611 and a fourth side 613 of the grip strip 600. Only the grip yarn knit courses are depicted. In reality, the grip strip 600 would also include non-grip courses. The grip strip 600 may comprise a first area 616 having a grip yarn course 617, where the grip yarn course 617 forms the width of the grip strip 600 in the first area 616. The grip yarn course 617 may extend in the course-wise direction (e.g., between the first side 610 and the second side 612) for a first length.

Continuing, the grip strip 600 comprises a second area 618 having a series of grip yarn courses 618*a*, 618*b*, and 618*c*, each grip yarn course 618*a*, 618*b*, and 618*c* in the second area 618 having a length extending in the course-wise direction between the first side and the second side 610 and 612. For illustrative purposes, a space is shown between the grip yarn courses, but in an actual knit construction the grip yarns courses would be interlooped. In example aspects, each grip yarn course 618*a*, 618*b*, and 618*c* may comprise, for example, one course. Each grip yarn course 618*a*, 618*b*, and 618*c* in the second area 618 is offset from a previous course in the second area 618 in the wale-wise direction between the third side and the fourth side 611 and 613. To describe this differently and with respect to a circular knit machine, the grip yarn course 617 may be knit in a first circular rotation of the circular knit machine, and the grip yarn course 618*a* may be knit in a second circular rotation of the circular knit machine, where the grip yarn course 618*a* is interlooped with grip yarn course 617 along only a portion of the length of grip yarn course 617. The grip yarn course 618*b* is knit in a third circular rotation of the circular knit machine, and the grip yarn course 618*c* would be knit a fourth circular rotation of the circular knit machine, where the grip yarn course 618*b* is interlooped with the grip yarn course 618*a* along only a portion of the length of the grip yarn course 618*a*, and grip yarn course 618*c* is interlooped with the grip yarn course 618*b* along only a portion of the length of the grip yarn course 618*b*. The result of this construction is a staggered configuration of grip yarn courses.

The grip strip 600 further comprises a third area 620 having grip yarn course 620*a* and grip yarn course 620*b* knit in a fifth and sixth circular rotation respectively of the circular knit machine. As seen, the number of grip yarn courses in the third area 620 is greater than the number of grip yarn courses in the first area 616 (two courses versus one course) causing the third area 620 of the grip strip 600 to have a greater width than the first area 616 of the grip strip 600. In example aspects, the grip yarn course 620*a* and the grip yarn course 620*b* in the third area 620 may have generally the same length and be interlooped with each other along an entirety of the respective lengths. The grip yarn course 620*a* is partially offset from the grip yarn course 618*c* in the wale-wise direction between the third side and the fourth side 611 and 613. As shown, the grip yarn course 620*a* is interlooped with the grip yarn course 618*c* along a portion of the length of the grip yarn course 618*c*.

The grip strip 600 may additionally comprise a fourth area 622 having grip yarn course 622*a* and grip yarn course 622*b*. In example aspects, the grip yarn course 622*a* may be knit in the fourth circular rotation of the circular knit machine which is the same circular rotation as used to knit the grip yarn course 618*c*. The grip yarn course 622*a* is offset in the course-wise direction between the first side and the second side 610 and 612 from the grip yarn course 618*c*, and non-grip yarn loops (not shown) would extend between the grip yarn course 622*a* and the grip yarn course 618*c*. The grip yarn course 622*b* may be knit in the third circular rotation of the circular knit machine which is the same circular rotation as used to knit the grip yarn course 618*b*. The grip yarn course 622*b* is offset in the course-wise direction between the first side and the second side 610 and 612 from the grip yarn course 618*b*, and non-grip yarn loops (not shown) would extend between the grip yarn course 622*b* and the grip yarn course 618*b*. Continuing, as shown, the grip yarn course 622*a* may be interlooped with the grip yarn course 620*a* along a portion of the length of the grip yarn course 620*a*. And the grip yarn course 622*b* may be interlooped with the grip yarn course 622*a* along an entirety of the length of the grip yarn course 622*a*. The grip yarn course 622*b* may further extend into a fifth area 624 of the grip strip 600 as described below.

With respect to the fifth area 624, the fifth area 624 of the grip strip 600 comprises the grip yarn course 622*b*, a grip yarn course 624*a*, and a grip yarn course 624*b*. In example aspects, the grip yarn course 624*a* may be knit in the second circular rotation of the circular knit machine which is the same circular rotation as used to knit the grip yarn course 618*a*. The grip yarn course 624*a* is offset in the course-wise direction between the first side and the second side 610 and 612 from the grip yarn course 618*a*, and non-grip yarn loops (not shown) would extend between the grip yarn course 624*a* and the grip yarn course 618*a*. And the grip yarn course 624*b* may be knit in the first circular rotation of the circular knit machine which is the same circular rotation as used to knit the grip yarn course 617. The grip yarn course 624*b* is offset in the course-wise direction between the first side and the second side 610 and 612 from the grip yarn course 617, and non-grip yarn loops (not shown) would extend between the grip yarn course 624*b* and the grip yarn course 617. As shown, the grip yarn course 624*a* is interlooped along its entire length with the grip yarn course 622*b*, and the grip yarn course 624*b* is interlooped along it entire length with the grip yarn course 624*a*. The result is that the fifth area 624 may have a width generally equal to three grip yarn courses such that it is wider than, for instance, the first area 616.

The interrelationship of the grip yarn courses for the grip strip 600 is illustrative only and it is contemplated that other arrangements of grip yarn courses may be used to change the width of the grip strip 600 and/or to create offset in the wale-wise direction. The result is the ability to customize the path of a particular grip strip on a sock to account for motion and/or contact forces likely to be experienced by the sock.

As set forth, the adding and/or offsetting of grip yarn courses to a grip strip to change the width of the grip strip and/or to create offset in the wale-wise direction of the grip strip may be achieved by knitting a course on a circular knit machine or flat knit machine using, for instance, a first yarn type (a non-grip yarn type) and dropping in a second yarn type (grip yarn type) when indicated by, for example, a bitmap. When the second yarn type is dropped in, the first yarn type may be dropped out. Once the second yarn type is dropped in, it may be knitted along that course to form a predefined number of knit loops. When the predefined number of knit loops are knit, the second yarn type may be dropped out of the knitting cycle and replaced with, for example, the first yarn type that is knit for a predetermined number of knit loops. When the predefined number of knit loops are knit, the first yarn type may again be dropped out of the knitting cycle and replaced with, for instance, the second yarn type. This is an illustrative example only, and other variations are contemplated herein such as only dropping in the second yarn type once along a particular course, or dropping in the second yarn type multiple times along a particular course (i.e., along a particular circular rotation of the circular knit machine). It is contemplated herein that when the first and second yarn types are dropped out, they may be floated until dropped back in again. Or if the float distance exceeds a certain number of needle positions, the first and second yarn types may be cut and secured and reintroduced when needed. Any and all aspects, and any variation thereof, are contemplated as being within the scope herein.

Figure 7:
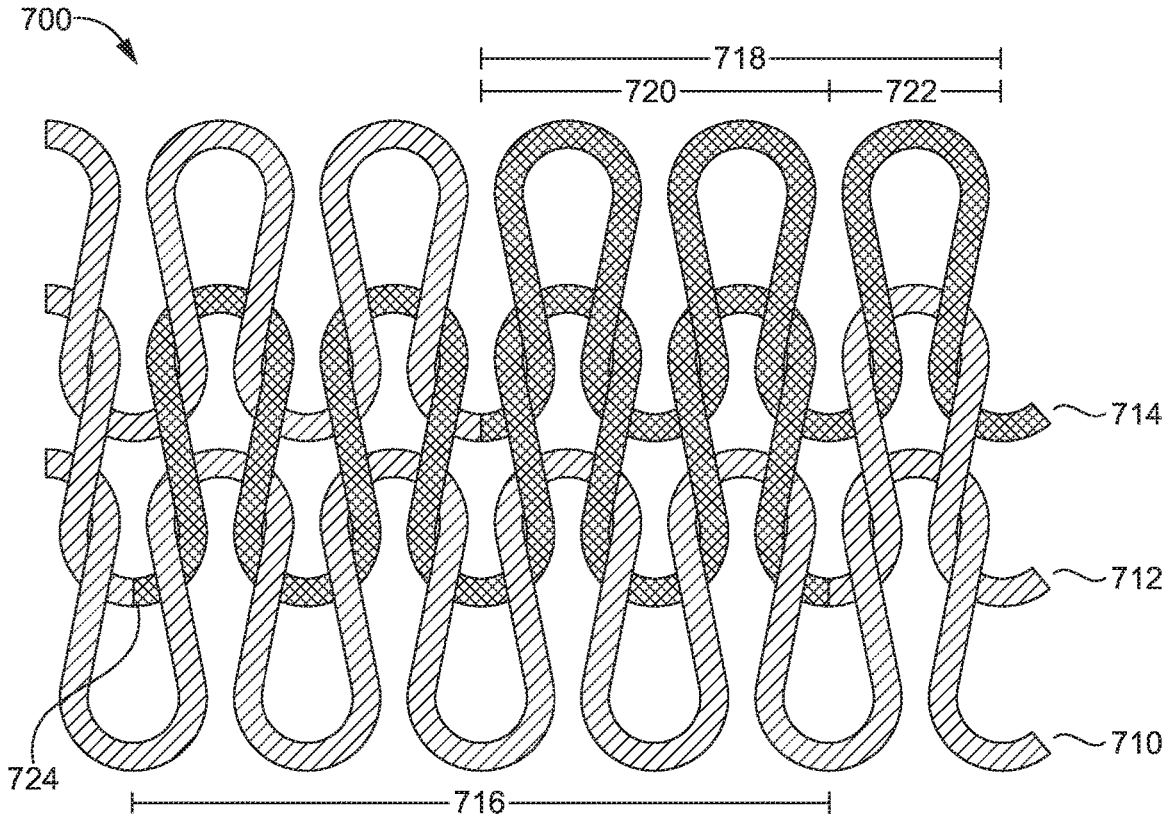
FIG. 7 illustrates an example knit structure depicting a grip strip having two grip yarn courses, wherein one of the grip yarn courses is offset in a wale-wise direction from the previous grip yarn course.
Figure 8:
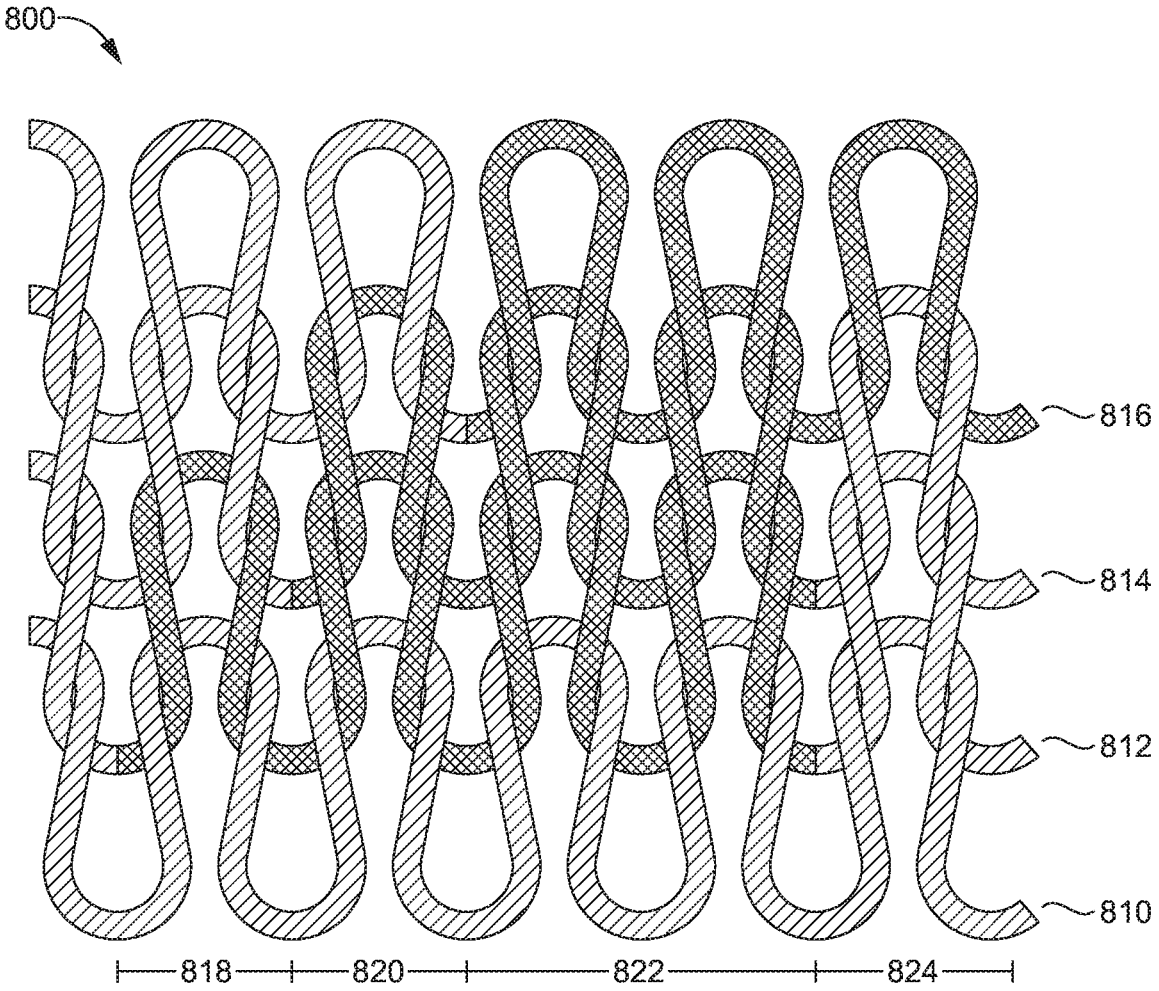
FIG. 8 illustrates an example knit structure depicting areas of a grip strip where each area has a different number of knit courses in accordance with aspects herein.
Figure 9:
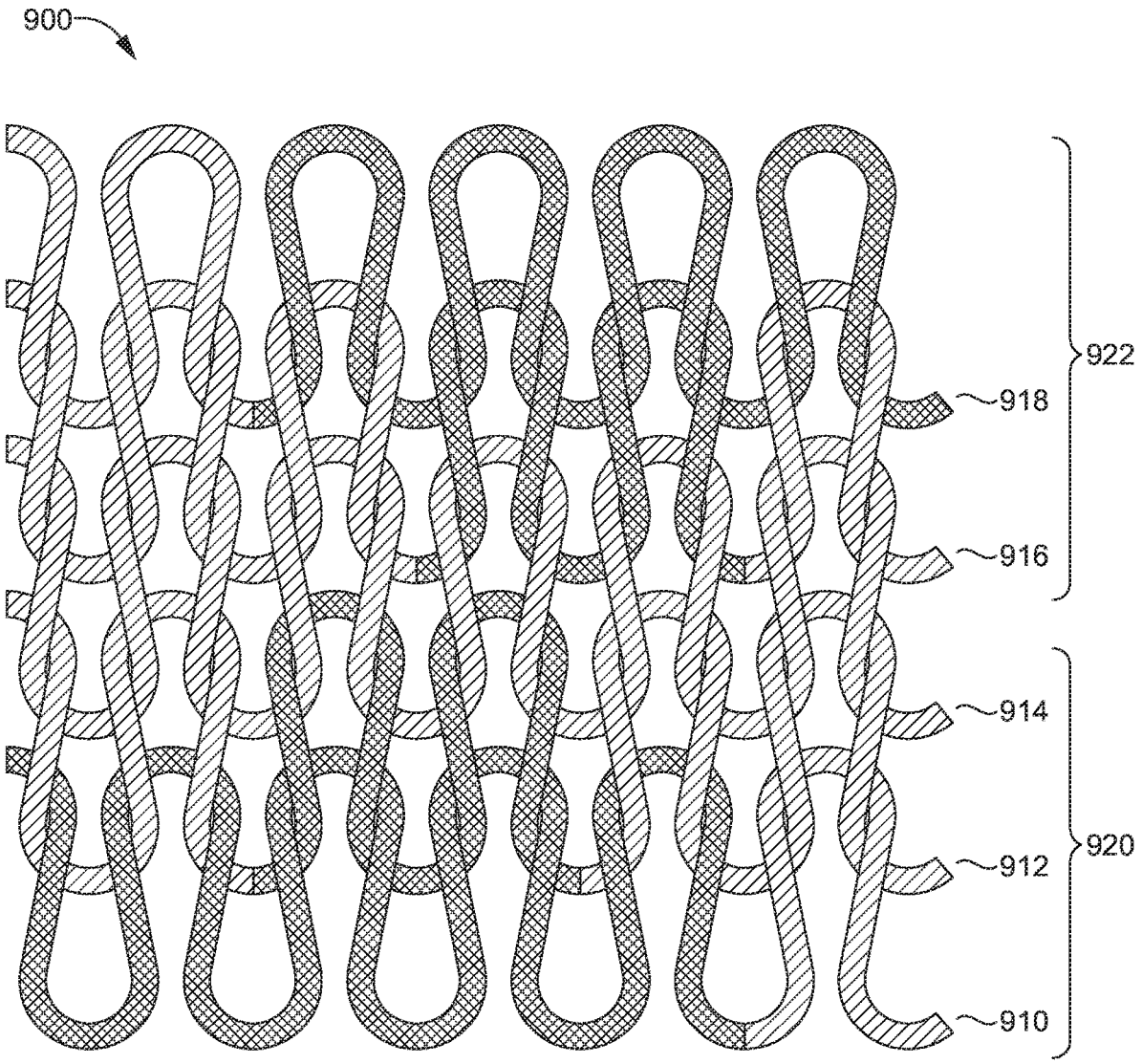
FIG. 9 illustrates an example knit structure where a yarn course formed from a non-grip yarn type is positioned between a first integrally knit grip strip and a second integrally knit grip strip in accordance with aspects herein.

Turning to FIGS. 7-9, these figures illustrate example knit structures 700, 800, and 900 used to form grip strips such as the grip strips shown on the sock 100. In FIGS. 7-9, grip yarns are depicted with cross-hatching while non-grip yarns are shown with single hatching. FIG. 7 is provided to illustrate how a grip yarn course may be interlooped with a previous grip yarn course along a portion of the length of the previous grip yarn course. The knit structure 700 comprises a first knit course 710 formed from a non-grip yarn, where the first knit course 710 comprises a series of knit loops. The first knit course 710 may be knit during a first circular rotation of a circular knit machine. The knit structure 700 further comprises a second knit course 712 comprising the non-grip yarn and the grip yarn knit in a series of knit loops, where the second knit course 712 may be knit during a second circular rotation of the circular knit machine. In example aspects, the grip yarn in the second knit course 712 may be knit to have a length 716. As shown, the grip yarn in the second knit course 712 is interlooped with the non-grip yarn in the first knit course 710 along the length 716. The knit structure 700 further comprises a third knit course 714 comprising the non-grip yarn and the grip yarn knit in a series of knit loops, where the third knit course 714 may be knit during a third circular rotation of the circular knit machine. The grip yarn in the third knit course 714 may be knit to have a length 718. As shown, the grip yarn in the third knit course 714 is interlooped with the grip yarn in the second knit course 712 along a length 720, where the length 720 is less than the length 716 of the grip yarn in the second knit course 712. In other words, the grip yarn in the third knit course 714 is interlooped with the grip yarn in the second knit course 712 along only a portion of the length of the grip yarn in the second knit course 712. The remaining loops of the grip yarn in the third knit course 714 are interlooped with non-grip yarns in the second knit course 712 along a length 722. The result of the knit structure 700 is a grip strip having areas comprising a single course of grip yarns and areas comprising two interlooped courses of grip yarn to provide a varying width to the grip strip.

Reference numeral 724 in FIG. 7 indicates an example transition between the non-grip yarn and the grip yarn. In aspects, this may represent the point in the knitting cycle where the grip yarn is introduced or dropped in, and the non-grip yarn is removed or dropped out. In one example aspect, the non-grip yarn may be cut and secured (e.g., tied) once dropped out. In another example aspect, the non-grip yarn may be floated until re-introduced. Any and all aspects, and any variation thereof, are contemplated as being within aspects herein.

FIG. 8 depicts the knit structure 800 having a first knit course 810, a second knit course 812, a third knit course 814, and a fourth knit course 816. In example aspects, the first knit course 810 may be formed from the non-grip yarn knit in a series of loops. The second knit course 812 may comprise the non-grip yarn and the grip yarn, where the grip yarn is knit to have a predetermined length. The third knit course 814 may comprise the non-grip yarn and the grip yarn, where the grip yarn is knit to have a predetermined length, and the fourth knit course 816 may comprise the non-grip yarn and the grip yarn, where the grip yarn is knit to have a predetermined length.

The positioning of the grip yarn loops in the second knit course 812, the third knit course 814, and the fourth knit course 816 may be offset from one another in the wale-wise direction. That is, the grip yarns in the second knit course 812, the third knit course 814, and the fourth knit course 816 may be knit in different circular rotations of the circular knit machine. In example aspects, the third knit course 814 may be interlooped with the grip yarn in the second knit course 812 along a portion of the length of the grip yarn in the second knit course 812. And the grip yarn in the fourth knit course 816 may be interlooped with the grip yarn in the third knit course 814 along a portion of the length of the grip yarn in the third knit course 814. The result is that the grip strip comprises different areas having a different number of grip yarn courses. For instance, area 818 comprise one grip yarn course, area 820 comprises two grip yarn courses, area 822 comprises three grip yarn courses, and area 824 comprises one grip yarn course. A result of this is that the grip strip has a varying width in the wale-wise direction along the length of the grip strip.

The knit structure 900 in FIG. 9 is provided to illustrate how non-grip yarn courses may separate adjacent grip strips. The knit structure 900 includes a first knit course 910 (knit during a first circular rotation of the circular knit machine) comprising grip yarn loops and non-grip yarn loops. A second knit course 912 (knit during a second circular rotation of the circular knit machine) of the knit structure 900 also comprises grip yarn loops and non-grip yarn loops where the second knit course 912 is interlooped with the first knit course 910. Together the first knit course 910 and the second knit course 912 form a first grip strip 920. The knit structure 900 further includes a third knit course 914 (knit during a third circular rotation of the circular knit machine) comprising only non-grip yarns (i.e., the third knit course 914 is not formed with any grip yarns). The third knit course 914 is interlooped with the second knit course 912. Continuing, the knit structure 900 further comprises a fourth knit course 916 (knit during a fourth circular rotation of the circular knit machine) comprising grip yarns and non-grip yarns, where the fourth knit course 916 is interlooped with the third knit course 914. Additionally, the knit structure includes a fifth knit course 918 (knit during a fifth circular rotation of the circular knit machine) having grip yarns and non-grip yarns; the fifth knit course 918 is interlooped with the fourth knit course 916 to form a second grip strip 922. As seen, the third knit course 914 separates or spaces apart the first grip strip 920 and the second grip strip 922. The knit structure 900 is illustrative only, and it is contemplated herein that additional knit courses may be included in the first grip strip 920, the second grip strip 922, and/or the third knit course 914. By positioning non-grip yarn knit courses between adjacent grip strips, and by varying the number of non-grip yarn knit courses used to separate adjacent grip strips, the amount of grip in a sock, such as the sock 100, may be adjusted to provide appropriate levels of traction.

Figure 10:
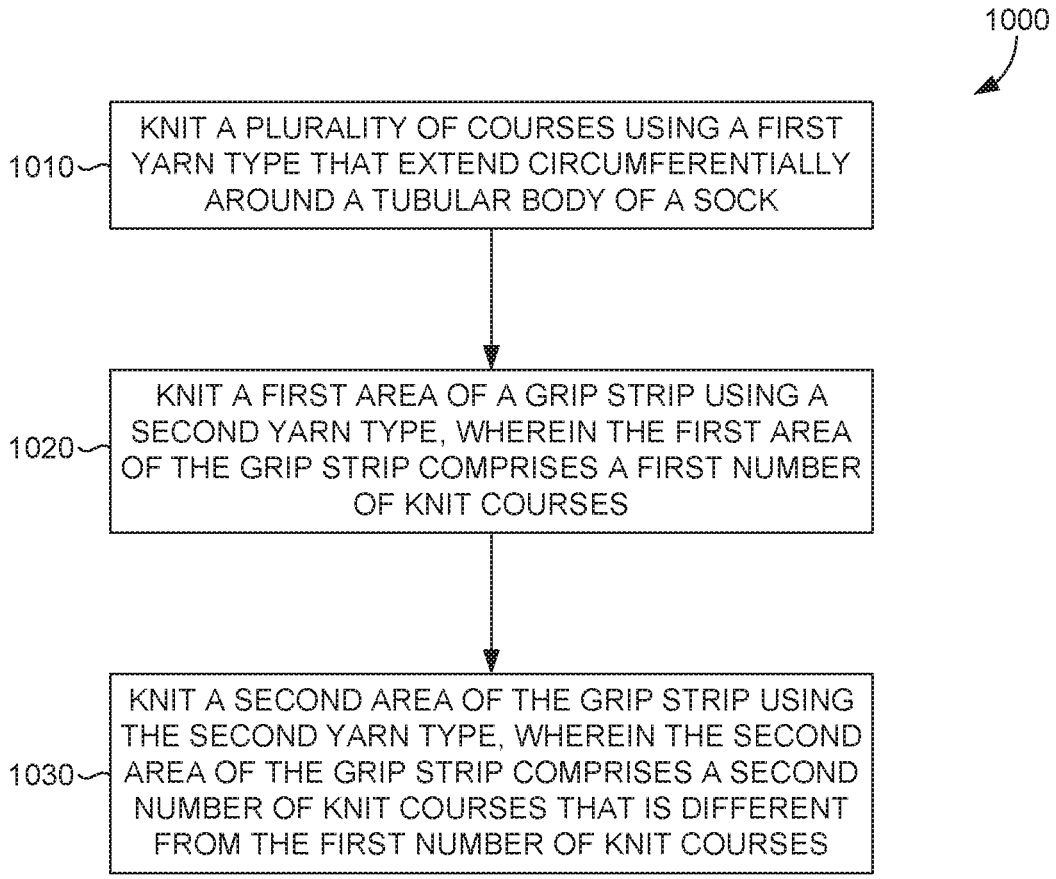
FIG. 10 illustrates a flow diagram of an example method of knitting a sock having grip strips of varying widths in accordance with aspects herein.

Turning now to FIG. 10, a flow diagram of an example method 1000 of knitting a sock, such as the sock 100, is provided in accordance with aspects herein. In example aspects, it is contemplated herein that the sock may be knit on a circular knit machine such as a 200 needle circular knit machine. It is also contemplated herein that the sock may be knit on a two-bed flat knit machine. Any and all aspects are contemplated herein. At a step 1010, a plurality of knit courses are knit using a first yarn type, where the plurality of knit courses may be knit circumferentially on a circular knit machine so as to form a tubular body, such as the tubular sock body 110, of a sock. To describe this differently, the plurality of knit courses may extend circumferentially around the tubular body of the sock. In aspects, the first yarn type comprises a non-grip yarn having a denier per filament of greater than 0.1. In aspects, the first yarn type may comprise 2 ends or strands of 60 denier polyester twisted together where each stand comprises 36 filaments. It is contemplated herein that the plurality of knit courses knit using the first yarn type may have a first knit stitch type such as, for instance, a 1×1 pique (flat) knit stitch type.

At a step 1020, a first area of a grip strip is knit using a second yarn type where the first area may comprise a first number of grip yarn knit courses. And at a step 1030, a second area of the grip strip is knit using the second yarn type where the second area may comprise a second number of grip yarn knit courses that is different from the first number of knit yarn courses. In example aspects, the grip strip may be knit to extend circumferentially around the tubular body. More particularly, the grip strip may be knit to extend circumferentially around a mid-foot area of the tubular body. The second yarn type may comprise a yarn having a denier per filament of about 0.1 or less. An example yarn may comprise an elastomeric yarn that is wrapped with two ends or strands of a yarn having a denier per filament of about 0.1 or less. The elastomeric yarn may further be wrapped with additional yarns such as nylon yarns.

It is contemplated herein that a different knit stitch type may be used to knit the grip yarn knit courses that form the grip strip. For example, the grip yarn knit courses may be knit with a terry loop structure where the loop portion of the terry loops is positioned on an inner-facing surface of the tubular body of the sock (e.g., the surface of the sock configured to face a skin surface of a wearer). It is contemplated herein that the grip yarn knit courses may be present on both the technical face and the technical back of the tubular body (i.e., a single knit construction) such that the grip features are present on both the inner-facing surface of the tubular body and the outer-facing surface of the tubular body to provide a grip surface between the sock a wearer's skin surface and a grip surface between the sock and a wearer's shoe.

In one example aspect, the first yarn and the second yarn (e.g., the grip yarn) may be plated with an additional yarn. In one example aspect, the plating yarn may include an elastomeric yarn to provide additional stretch characteristics to the sock. More particularly, the plating yarn may comprise a 22 decitex spandex yarn covered with two ends or strands of 50 denier polyester although other plating yarns are contemplated herein.

The method 1000 may additionally comprise knitting a leg portion of the sock using the first yarn type, such as the leg portion 122 of the sock 100, where the leg portion includes a collar that forms an opening in communication with the tubular body. In example aspects, the leg portion may be knit with a 2×2 rib structure. Additional knitting steps may comprises knitting in a plurality of grip strips using the second yarn type in an Achilles tendon area of the leg portion, such as the third plurality of grip strips 512 of the sock 100, and knitting in grip strips that do not extend circumferentially around the tubular body of the sock, such as the second plurality of grip strips 126 of the sock 100. As well, the method 1000 may comprise knitting a plantar toe area using the second yarn type, such as the plantar toe area 412 of the sock 100, where the plantar toe area comprises a continuous expanse of interlooped courses comprising the second yarn type, and knitting a dorsal toe area using the first yarn type, such as the dorsal toe area 330 of the sock 100, where the dorsal toe area comprises a continuous expanse of interlooped courses comprising the first yarn type.

As set forth above, when knitting the grip strips it is contemplated herein that the second yarn type may be dropped in and dropped out according to, for instance knit program. In areas where the second yarn type is not part of the knitting sequence, the second yarn type may be floated until dropped in again. For instance, if the second yarn type is to be dropped in 10 needles or less from a previous knitting sequence, the second yarn type may be floated. But if the second yarn type is to be dropped in greater than 10 needles from the previous knitting sequence, the second yarn type may be cut, secured, and reintroduced when needed to avoid overly long floats and to improve wearer comfort. For yarn courses that also include the first yarn type, a similar description applies.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A knit sock comprising:

a sock body comprising a tubular body forming a perimeter around a foot-receiving cavity, the sock body comprising a toe end, a heel area, and a foot opening in communication with the foot-receiving cavity, the sock body formed from at least a first yarn type and a second yarn type, the second yarn type comprising a yarn having a denier per filament of about 0.1 or less; and at least one integrally knit grip strip comprising the second yarn type, the grip strip comprising a first area having a first number of knit courses and a second area comprising a second number of knit courses, wherein the first number of knit courses is different from the second number of knit courses.

Clause 2. The knit sock according to clause 1, wherein the grip strip extends circumferentially around the tubular body.

Clause 3. The knit sock according to any of clauses 1 through 2, wherein the grip strip extends circumferentially around the tubular body at a mid-foot area of the sock body.

Clause 4. The knit sock according to any of clauses 1 through 3, wherein the grip strip comprises a first end and a second end, and wherein the first end is contiguous with the second end.

Clause 5. The knit sock according to any of clauses 1 through 4, wherein the first area of the grip strip comprises a fewer number of knit courses than the second area of the grip strip.

Clause 6. The knit sock according to any of clauses 1 through 5, wherein the first area of the grip strip is located on a dorsal portion of the knit sock.

Clause 7. The knit sock according to any of clauses 1 through 6, wherein the second area of the grip strip is located on a plantar portion of the knit sock.

Clause 8. The knit sock according to any of clauses 1 through 7, wherein the grip strip further comprises a third area having a third number of knit courses, wherein the third number of knit courses is greater than the first number of knit courses.

Clause 9. The knit sock according to clause 8, wherein the third area of the grip strip is located on one or more of a medial portion of the knit sock and a lateral portion of the knit sock.

Clause 10. The knit sock according to any of clauses 1 through 9, wherein the knit courses that form the grip strip comprise a terry loop structure, and wherein the terry loop structure is positioned on a surface of the sock body that faces the foot-receiving cavity.

Clause 11. A knit sock comprising:

a sock body comprising a tubular body forming a perimeter around a foot-receiving cavity, the sock body comprising a toe end, a heel area, and a foot opening in communication with the foot-receiving cavity, the sock body formed from at least a first yarn type and a second yarn type, the second yarn type comprising a yarn having a denier per filament of about 0.1 or less; and a first integrally knit grip strip that extends circumferentially around the tubular body, the first grip strip comprising the second yarn type, the first grip strip comprising a first area having a first number of knit courses and a second area comprising a second number of knit courses, wherein the first number of knit courses is different from the second number of knit courses.

Clause 12. The knit sock according to clause 11, wherein the first grip strip extends circumferentially around a mid-foot area of the sock body.

Clause 13. The knit sock according to clause 11, wherein the first grip strip comprises a first end and a second end, and wherein the first end is contiguous with the second end.

Clause 14. The knit sock according to any of clauses 11 through 13, further comprising a second integrally knit grip strip, the second grip strip comprising the second yarn type, the second grip strip comprising a first area having a first number of knit courses and a second area comprising a second number of knit courses, wherein the first number of knit courses is different from the second number of knit courses.

Clause 15. The knit sock according to any of clauses 11 through 14, further comprising a knit course comprising the first yarn type, the knit course comprising the first yarn type positioned between the first grip strip and the second grip strip.

Clause 16. The knit sock according to clause 15, wherein the knit course comprising the first yarn type is interlooped with at least a knit course forming one or more of the first grip strip and the second grip strip.

Clause 17. A method of knitting a sock, the method comprising:

knitting a tubular body of the sock using a first yarn type and a second yarn type, the second yarn type comprising a yarn having a denier per filament of about 0.1 or less, wherein knitting the tubular body of the sock comprises:

knitting a plurality of knit courses using the first yarn type on a circular knit machine, the plurality of knit courses extending circumferentially around the tubular body;

knitting a grip strip using the second yarn type, wherein knitting the grip strip comprises knitting a first area having a first number of knit courses and knitting a second area having a second number of knit courses, and wherein the first number of knit courses is different from the second number of knit courses.

Clause 18. The method of knitting the sock according to clause 17, wherein the grip strip extends circumferentially around the tubular body.

Clause 19. The method of knitting the sock according to any of clauses 17 through 18, wherein the grip strip extends circumferentially around a mid-foot area of the sock.

Clause 20. The method of knitting the sock according to any of clauses 17 through 19, wherein the grip strip comprises a first end and a second end, and wherein the first end is contiguous with the second end.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A knit sock comprising:

a sock body comprising a tubular body forming a perimeter around a foot-receiving cavity, the sock body comprising a toe end, a heel area, and a foot opening in communication with the foot-receiving cavity, the sock body including a longitudinal axis that extends from the toe end to the foot opening and a transverse axis that extends between a medial side and a lateral side of the sock body, wherein the transverse axis intersects the longitudinal axis, the sock body formed from at least a first yarn type and a second yarn type, the second yarn type comprising a yarn having a denier per filament of about 0.1 or less; and an integrally knit grip strip extending circumferentially around the tubular body and comprising the second yarn type, the integrally knit grip strip comprising a first area having a first number of knit courses, a second area comprising a second number of knit courses, and a third area comprising a third number of knit courses, the first number of knit courses and the third number of knit courses each being less than the second number of knit courses, wherein the second area is positioned between the first area and the third area along the transverse axis of the sock body, and wherein a first knit course of the first number of knit courses is directly interlooped with a first knit course of the second number of knit courses.

2. The knit sock of claim 1, wherein the integrally knit grip strip extends circumferentially around the tubular body at a mid-foot area of the sock body.

3. The knit sock of claim 1, wherein the integrally knit grip strip comprises a first end and a second end, and wherein a yarn from the first end is directly interlooped with a yarn from the second end.

4. The knit sock of claim 1, wherein the first area of the integrally knit grip strip is located on a dorsal portion of the knit sock.

5. The knit sock of claim 4, wherein the second area of the integrally knit grip strip is located on a plantar portion of the knit sock.

6. The knit sock of claim 1, wherein each of the first number of knit courses, the second number of knit courses, and the third number of knit courses that form the integrally knit grip strip comprise a terry loop structure, and wherein the terry loop structure is positioned on a surface of the sock body that faces the foot-receiving cavity.

7. A knit sock comprising:

a sock body comprising a tubular body forming a perimeter around a foot-receiving cavity, the sock body comprising a toe end, a heel area, and a foot opening in communication with the foot-receiving cavity, the sock body including a longitudinal axis that extends from the toe end to the foot opening and a transverse axis that extends between a medial side and a lateral side of the sock body, wherein the transverse axis intersects the longitudinal axis, the sock body formed from at least a first yarn type and a second yarn type, the second yarn type comprising a yarn having a denier per filament of about 0.1 or less; and a first integrally knit grip strip that extends circumferentially around the tubular body, the first integrally knit grip strip comprising the second yarn type, the first integrally knit grip strip comprising a first area having a first number of knit courses, a second area comprising a second number of knit courses, and a third area comprising a third number of knit courses, the first number of knit courses and the third number of knit courses each being less than the second number of knit courses, wherein the second area is positioned between the first area and the third area along the transverse axis of the sock body, and wherein a first knit course of the first number of knit courses is directly interlooped with a first knit course of the second number of knit courses.

8. The knit sock of claim 7, wherein the first integrally knit grip strip extends circumferentially around a mid-foot area of the sock body.

9. The knit sock of claim 7, wherein the first integrally knit grip strip comprises a first end and a second end, and wherein a yarn from the first end is directly interlooped with a yarn from the second end.

10. The knit sock of claim 7, further comprising a second integrally knit grip strip, the second integrally knit grip strip comprising the second yarn type, the second integrally knit grip strip comprising a first area having a first number of knit courses and a second area comprising a second number of knit courses, wherein the first number of knit courses is different from the second number of knit courses.

11. The knit sock of claim 10, further comprising a knit course comprising the first yarn type, the knit course comprising the first yarn type positioned between the first integrally knit grip strip and the second integrally knit grip strip.

12. The knit sock of claim 11, wherein the knit course comprising the first yarn type is directly interlooped with at least a knit course forming one or more of the first integrally knit grip strip and the second integrally knit grip strip.

13. A method of knitting a sock, the method comprising:

knitting a tubular body of the sock using a first yarn type and a second yarn type, the tubular body including a longitudinal axis that extends from a toe end to a foot opening and a transverse axis that extends between a medial side and a lateral side of the tubular body, wherein the transverse axis intersects the longitudinal axis, wherein the second yarn type comprises a yarn having a denier per filament of about 0.1 or less, and wherein knitting the tubular body of the sock comprises:

knitting a plurality of knit courses using the first yarn type on a circular knit machine, the plurality of knit courses extending circumferentially around the tubular body; and knitting a grip strip using the second yarn type, wherein knitting the grip strip comprises knitting a first area having a first number of knit courses, knitting a second area having a second number of knit courses, and knitting a third area comprising a third number of knit courses, the first number of knit courses and the third number of knit courses each being less than the second number of knit courses, wherein the second area is positioned between the first area and the third area along the transverse axis of the tubular body, and wherein a first knit course of the first number of knit courses is directly interlooped with a first knit course of the second number of knit courses.

14. The method of knitting the sock of claim 13, wherein the grip strip extends circumferentially around the tubular body.

15. The method of knitting the sock of claim 14, wherein the grip strip extends circumferentially around a mid-foot area of the sock.

16. The method of knitting the sock of claim 14, wherein the grip strip comprises a first end and a second end, and wherein a yarn from the first end is directly interlooped with a yarn from the second end.

* * * * *